US005930994A

United States Patent [19]

Shimato et al.

[11] Patent Number: 5,930,994

[45] Date of Patent: Aug. 3, 1999

[54] REVERSE CLEANING REGENERATION TYPE EXHAUST EMISSION CONTROL DEVICE AND METHOD OF REGENERATING THE SAME

[75] Inventors: Koji Shimato; Kazuya Naruse; Norihiko Yamamura; Hirosi Demati; Takaya Naiki, all of Ibi-Gun, Japan

[73] Assignee: Ibiden Co., Ltd., Ohgaki, Japan

[21] Appl. No.: 08/882,138

[22] Filed: Jun. 25, 1997

[30] Foreign Application Priority Data

Jul. 2, 1996 [JP] Japan ..... 8-192852

[51] Int. Cl.[6] ..... F01N 3/02

[52] U.S. Cl. ..... 60/274; 55/302; 55/DIG. 30; 60/311

[58] Field of Search ..... 60/274, 295, 296, 60/300, 303, 311; 55/302, DIG. 30, 284

[56] References Cited

U.S. PATENT DOCUMENTS

| | | | |
|---|---|---|---|
| 4,373,330 | 2/1983 | Stark | 60/311 |
| 5,085,049 | 2/1992 | Rim et al. | 60/274 |
| 5,566,545 | 10/1996 | Hijikata et al. | 60/274 |
| 5,701,735 | 12/1997 | Kawaguchi | 60/274 |

FOREIGN PATENT DOCUMENTS

| | | |
|---|---|---|
| A2 0-308972 | 3/1989 | European Pat. Off. . |
| A1 0-674098 | 9/1995 | European Pat. Off. . |
| C1 42-01402 | 1/1993 | Germany . |
| A 4-183917 | 6/1992 | Japan . |
| A 7-71226 | 3/1995 | Japan . |
| A 7-119441 | 5/1995 | Japan . |

OTHER PUBLICATIONS

Tanabe, Hideaki et al. "Development and Study on Disel Particulate Trap System." *Journal of the M.E.S.J.*, vol. 27, No. 6, pp. 446–452, Jun. 27, 1992.

*Primary Examiner*—Tony M. Argenbright
*Attorney, Agent, or Firm*—Oliff & Berridge, PLC

[57] ABSTRACT

A reverse cleaning regeneration type exhaust emission control device includes two exhaust emission routes communicated with an inlet port of an exhaust emission path. The device includes first path A having a filter A1, a valve A2 and a nozzle A3 and a second path B having a filter B1, a valve B2 and a nozzle B3, and a third path C arranged at an upstream side of the filters A1 and B1 separately from the exhaust emission path extending from the inlet port of the exhaust emission and having a filter C1, a valve C2 and a nozzle C3. The reverse cleanings of the filters A1 and B1 are alternately carried out during the working of the device.

10 Claims, 7 Drawing Sheets

REVERSE CLEANING REGENERATION TYPE EXHAUST EMISSION CONTROL DEVICE AND METHOD OF REGENERATING THE SAME

BACKGROUND OF THE INVENTION

1. Field of the Invention

This invention relates to an exhaust emission control device for removing particulate from an exhaust stream discharged from an internal combustion engine, and more particularly to a reverse cleaning regeneration type exhaust emission control device capable of continuously conducting regeneration of filters for the removal of particulate and a method of regenerating the same.

2. Description of Related Art

Recently, there becomes a problem that particulate emissions including in an exhaust stream discharged from an internal combustion engine for use in vehicles such as truck, bus and the like or construction machines harmfully exert upon environment and human body.

Therefore, an exhaust emission control device provided with a filter is arranged in an exhaust emission path extending from the internal combustion engine to catch and remove particulate included in the exhaust emission through the filter.

In the exhaust emission control device, it is necessary to take out the caught particulate from the filter and regenerate the filter. As a method of regenerating the filter, there has hitherto been known a method of burning out the particulate by directly feeding heat to the filter. In this method, however, there was caused a problem that the filter was fused by combustion heat of the particulate or broken by heat stress.

As a method of regenerating the filter without burning the particulate, there is known a reverse cleaning regeneration system in which a high-speed gas stream is supplied in a direction opposite to the flowing of the exhaust stream to remove out the particulate from the filter and then the removed particulate is burnt out in another container by using an electric heater.

When using such a reverse cleaning regeneration system, it is not required to directly feed high heat for regeneration to the filter, so that the breakage of the filter due to heat stress is not caused, and ash is not deposited on the filter, and the clogging in the filter is hardly caused.

However, if such a series of actions is carried out in a single filter, a back pressure in the exhaust emission path rises in the course of removing the particulate, which badly affects the operability of such a system.

For this end, there is proposed a method of using a pair of filters and alternately regenerating them (Nippon Hakuyo Kikan Gakkaishi, vol. 27, No. 6, pp 446–452).

In the latter method, as shown in FIG. 1, the reverse cleaning regeneration type exhaust emission control device comprises a pair of filters 1 and 4, in which exhaust emission (shown by arrow) passes through the filters 1 and 4 at a steady state. If it is intended to regenerate the filter 1, as shown in FIG. 2, a valve 2 disposed between the filter 1 and a discharge port is closed to prevent the flowing of air for regeneration to the discharge port. Then, as shown in FIG. 3, compression air is jetted through a nozzle 3 in a moment to conduct the removal of the particulate caught by the filter 1 and the regeneration of the filter 1. After the regeneration of the filter 1, as shown in FIG. 4, the valve 2 is again opened to conduct the usual removal of the particulate using the two filters 1 and 4.

During the above regeneration of the filter 1, the exhaust emission always passes through the filter 4, so that the removal of the particulate is continuously conducted.

The regeneration of the filter 4 is carried out in the same manner as in the regeneration of the filer 1 by using a valve 5 and a nozzle 6.

The above exhaust emission control device using the two filters can continuously conduct the reverse cleaning while continuing the removal of the particulate, so that it is possible to apply such a device to trucks running over a long distance and an internal combustion engine continuously operating in an unventilatable place for a long time.

Moreover, the working of the conventional reverse cleaning regeneration type exhaust emission control device was stopped by stopping the flow of the exhaust emission accompanied with the stop of the internal combustion engine. As a result, the burning of the particulate removed out from the filter is frequently stopped on the way, so that when the flowing of new exhaust emission is started at a state of leaving the particulate, there are caused problems that the efficiency of removing the particulate becomes bad and the pressure loss undesirably rises and the like.

SUMMARY OF THE INVENTION

It is, therefore, an object of the invention to solve the aforementioned problems of the conventional techniques and to provide a reverse cleaning regeneration type exhaust emission control device capable of continuously and efficiently conducting the reverse cleaning during the working of the device and a method of regenerating the same.

According to a first aspect of the invention, there is the provision of a reverse cleaning regeneration type exhaust emission control device comprising two exhaust emission routes communicated with an inlet port of an exhaust emission and comprised of a first path A comprising a filter A1, a valve A2 arranged at a downstream side of the filter A1 for shutting off exhaust emission and a nozzle A3 disposed between the filter A1 and the valve A2 for jetting reverse cleaning air to the filter A1 and a second path B comprising a filter B1, a valve B2 arranged at a downstream side of the filter B1 for shutting off exhaust emission and a nozzle B3 disposed between the filter B1 and the valve B2 for jetting reverse cleaning air to the filter B1, and a third path C arranged at an upstream side of the filters A1 and B1 separately from the exhaust emission path extending from the inlet port of the exhaust emission and communicating with the two exhaust emission routes and comprising a filter C1, a valve C2 arranged at any side of the filter C1 for intercepting the path and a nozzle C3 disposed between the filter C1 and the valve C2 for feeding air for combustion to the filter C3.

In the reverse cleaning regeneration type exhaust emission control device according to the invention, it is preferable that when the reverse cleaning air is jetted from the nozzle A3 or B3, a greater part of air jetted is fed to the third path C without flowing backward to the inlet port of the exhaust emission, that a guide member for introducing the reverse cleaning air into the path C is arranged on an end face of each of the filters A1 and B1 at its upstream side, that the exhaust emission path from the inlet port of the exhaust emission to the first and second paths A and B is arranged close to the filters A1 and B1, that a size of each of the first path A, second path B and the exhaust emission path is defined so as to suck the exhaust emission into a main stream of the reverse cleaning air, that guide members for introducing the exhaust emission into the first and second paths A and B are arranged on the exhaust emission path, and that a partition member is disposed in the exhaust emission path extending from the inlet port of the exhaust emission.

According to a second aspect of the invention, there is the provision of a method of regenerating a reverse cleaning regeneration type exhaust emission control device comprising two exhaust emission routes communicated with an inlet port of an exhaust emission and comprised of a first path A comprising a filter A1, a valve A2 arranged at a downstream side of the filter A1 for shutting off exhaust emission and a nozzle A3 disposed between the filter A1 and the valve A2 for jetting reverse cleaning air to the filter A1 and a second path B comprising a filter B1, a valve B2 arranged at a downstream side of the filter B1 for shutting off exhaust emission and a nozzle B3 disposed between the filter B1 and the valve B2 for jetting reverse cleaning air to the filter B1, and a third path C arranged at an upstream side of the filters A1 and B1 separately from the inlet port of the exhaust emission and communicating with the two exhaust emission routes and comprising a filter C1, a valve C2 arranged at any side of the filter C1 for intercepting the path and a nozzle C3 disposed between the filter C1 and the valve C2 for feeding air for combustion to the filter C3, which comprises alternately repeating a first regeneration treatment and a second regeneration treatment after the exhaust emission is passed through the filters A1 and B1 at opened state of the valve A2 and B2 to catch particulate from the exhaust emission by the filters A1 and B1, in which the first regeneration treatment comprises jetting the reverse cleaning air from the nozzle A3 at a state of closing the valve A2 and opening the valve C2 to remove the particulate from the filter A1, catching the removed particulate with the filter C1 and then feeding air for combustion from the nozzle C3 at a state of opening the valve A2 and closing the valve C2 to burn out the particulate in the filter C1, and the second regeneration treatment comprises jetting the reverse cleaning air from the nozzle B3 at a state of closing the valve B2 and opening the valve C2 to remove the particulate from the filter B1, catching the removed particulate with the filter C1 and then feeding air for combustion from the nozzle C3 at a state of opening the valve B2 and closing the valve C2 to burn out the particulate in the filter C1.

In the regeneration method, it is favorable that after the flowing of the exhaust emission is stopped to the first and second paths A and B, either the first or second regeneration treatment is completed, or after the flowing of the exhaust emission is started to the first and second paths A and B, either the first or second regeneration treatment is started.

In a preferable embodiment of the second aspect, an amount of the particulate caught is detected by a pressure difference between the upstream side and downstream side of the filter A1 and a pressure difference between the upstream side and the downstream side of the filter B1 and the reverse cleaning is carried out in accordance with the detected value.

In another preferable embodiment of the second aspect, a lower end position of the filter C1 is arranged so as to be equal to or lower than lower end positions of the filters A1 and B1 when the reverse cleaning air is jetted from the nozzle A3 or B3 to remove the particulate from the filter A1 or B1 and flow into the third path C without depositing in the first or second path A or B.

BRIEF DESCRIPTION OF THE DRAWINGS

The invention will be described with reference to the accompanying drawings, wherein.

DESCRIPTION OF PREFERRED EMBODIMENTS

The reverse cleaning regeneration type exhaust emission control device according to the invention is arranged in an exhaust emission path E connected to an exhaust side of an internal combustion engine, in which the exhaust emission path E is divided into two exhaust emission routes comprised of first path A and second path B in the front of the device and the exhaust emission passed through the paths A and B is discharged from exterior at the back of the device.

The first path A comprises a filter A1, a valve A2 arranged at a downstream side of the filter A1 for shutting off exhaust emission and a nozzle A3 disposed between the filter A1 and the valve A2 for jetting reverse cleaning air to the filter A1, while the second path B comprises a filter B1, a valve B2 arranged at a downstream side of the filter B1 for shutting off exhaust emission and a nozzle B3 disposed between the filter B1 and the valve B2 for jetting reverse cleaning air to the filter B1.

On the other hand, a third path C is arranged at an upstream side of the filters A1 and B1 separately from the exhaust emission path E extending from the inlet port of the exhaust emission so as to communicate with the two exhaust emission routes and comprises a filter C1, a valve C2 arranged at any side of the filter C1 for intercepting the path and a nozzle C3 disposed between the filter C1 and the valve C2 for feeding air for combustion to the filter C1.

Figure 5:
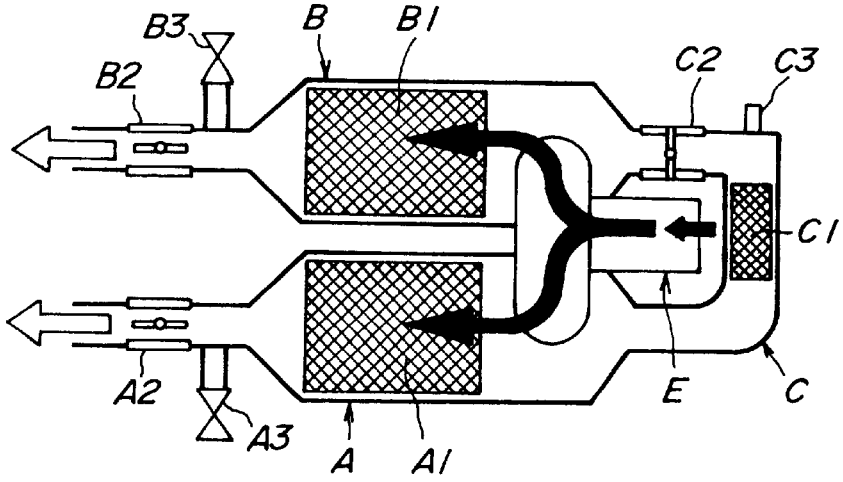
FIG. 5 is a diagrammatic view illustrating a steady running state of a first embodiment of the reverse cleaning regeneration type exhaust emission control device according to the invention.

In the steady running of the device as shown in FIG. 5, the valves A2 and B2 are at an opening state and the valve C2 is at a closing state, and the exhaust emission is passed through the first and second paths A and B to catch particulate included in the exhaust emission with the filters A1 and B1.

Figure 6:
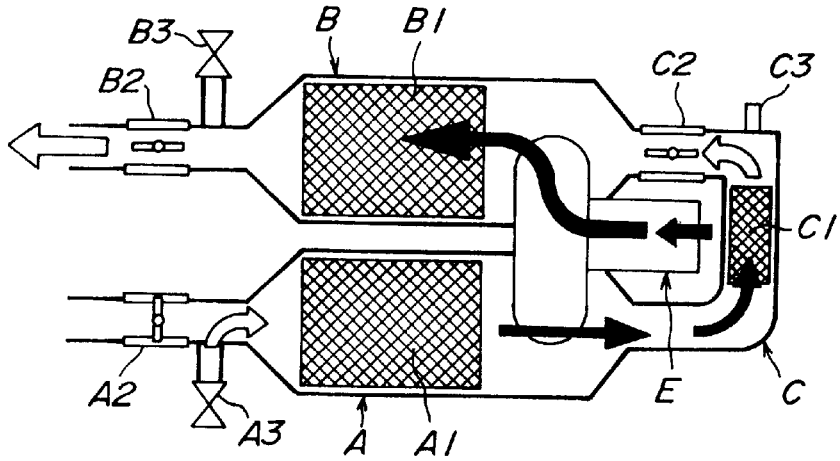
FIG. 6 is a diagrammatic view illustrating a reverse cleaning state of the first embodiment of the device according to the invention.

After the particulate is caught with the filters A1 and B1 for a given time, as shown in FIG. 6, the reverse cleaning of the filter A1 is carried out by closing the valve A2 and opening the valve C2 while maintaining the working of the filter B1 at the opened state of the valve B2 and jetting the reverse cleaning air from the nozzle A3 in a moment to remove the particulate from the filter A1 and introduce the removed particulate into the filter C1.

Figure 7:
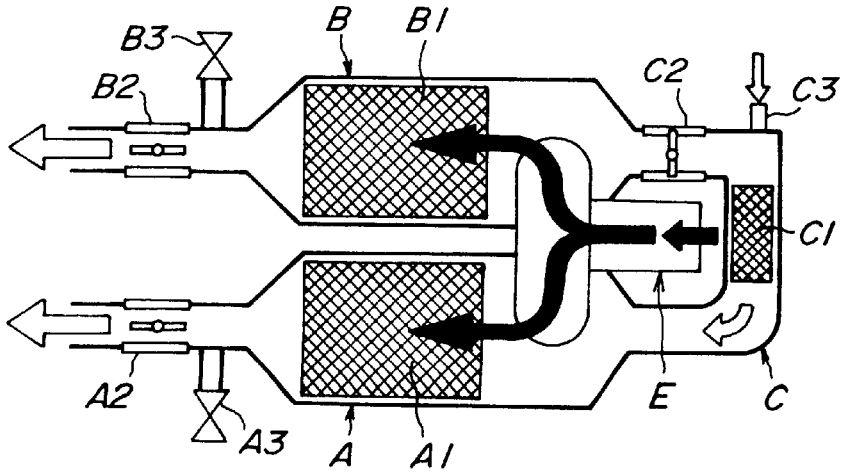
FIG. 7 is a diagrammatic view illustrating a regeneration state of a filter C1 at a restarting and steady running state of the first embodiment of the device according to the invention.

After the reverse cleaning of the filter A1, as shown in FIG. 7, air for combustion is fed from the nozzle C3 at the opened state of the valve A2 and the closed state of the valve C2 to burn out the particulate in the filter C1 by a heating means such as a heater or the like and then air passed through the filter C1 after the removal of the particulate is introduced into the filter A1 together with the exhaust emission.

This procedure is a first regeneration treatment.

On the other hand, after the particulate is caught in the filter B1 for a given time, the reverse cleaning of the filter B1 is carried out by closing the valve B2 and opening the valve C2 while maintaining the working of the filter A1 at the opened state of the valve A2 and jetting the reverse cleaning air from the nozzle B3 in a moment to remove the particulate from the filter B1 and introduce the removed particulate into the filter C1.

After the reverse cleaning of the filter B1, air for combustion is fed from the nozzle C3 at the opened state of the valve B2 and the closed state of the valve C2 to burn out the particulate in the filter C1 by a heating means such as a heater or the like and then air passed through the filter C1 after the removal of the particulate is introduced into the filter B1 together with the exhaust emission.

This procedure is a second regeneration treatment.

In the invention, the first and second regeneration treatments are alternately repeated while continuously working the reverse cleaning regeneration type exhaust emission control device.

In the device according to the invention, the reverse cleaned particulate is caught in the filter C1, so that the contaminated air is not leaked out in the outside of the device and also there is caused no contamination in the filter opposite to the reverse cleaned filter, the nozzle C3 for the assistance of combustion and the like in the device.

In the device according to the invention, the combustion of the particulate is carried out in the filter C1 just after the reverse cleaning while alternately repeating the reverse cleanings of the filters A1 and B1, so that the pressure loss can be maintained at a constant level.

Since the reverse cleaning air is fed in a direction opposite to the direction of the reverse cleaning air fed in the last reverse cleaning, the remaining particulate after the combustion of the filter C1 is blown out from the filter C1 and again caught by the filter A1 or B1 and hence the unburnt particulate is never left in the filter C1.

Since the removed particulate after the reverse cleaning of the filter A1 or B1 is caught by a single filter, the collection efficiency of the particulate is good and also the system using the device can be rendered into a closed system, so that the production of the device is easy and the device itself can be made small.

In the device according to the invention, the flowing of the reverse cleaning air can be controlled only by controlling the opening and closing operations of the valves through a sequencer, so that the back pressure in the exhaust emission path E from the engine is not raised, which is not badly affected upon the operability of the device.

Since the device according to the invention can continuously be worked for a long time, the internal combustion engine itself can be worked for a long time, so that the device can preferably be applied to trucks running over a long distance for a long time, internal combustion engines used in an inside of tunnel or coal mine and the like.

In the reverse cleaning regeneration type exhaust emission control device according to the invention, it is preferable that when the reverse cleaning air is jetted from the nozzle A3 or B3, a greater part of air jetted is fed to the third path C without flowing backward to the inlet port of the exhaust emission. For this purpose, there may be adopted the following means: that is, (1) a guide member for introducing the reverse cleaning air into the path C is arranged on an end face of each of the filters A1 and B1 at its upstream side, (2) the exhaust emission path from the inlet port of the exhaust emission to the first and second paths A and B is arranged close to the filters A1 and B1, (3) a size of each of the first path A, second path B and the exhaust emission path E is defined so as to suck the exhaust emission into a main stream of the reverse cleaning air, (4) guide members for introducing the exhaust emission into the first and second paths A and B are arranged on the inlet port of the exhaust emission, and (5) a partition member is disposed in the exhaust emission path E extending from the inlet port of the exhaust emission.

Figure 8:
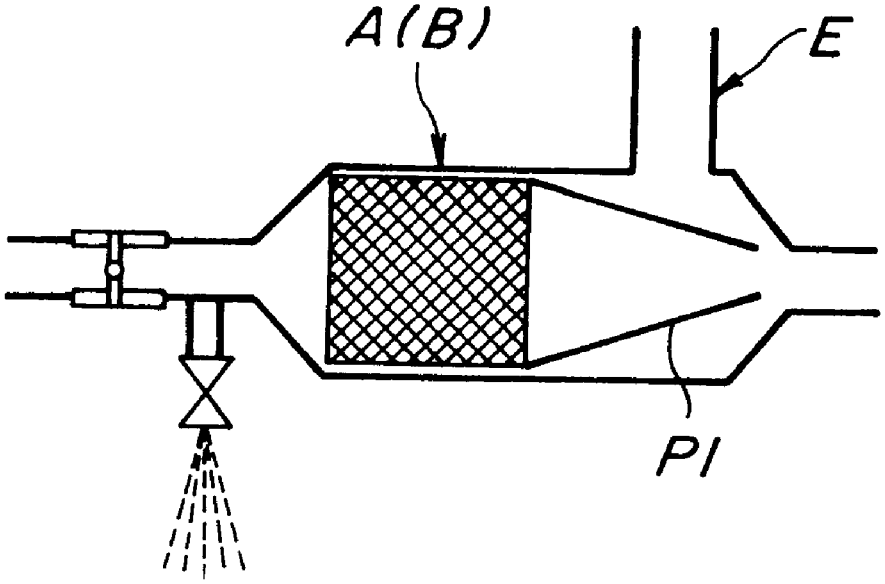
FIG. 8 is a diagrammatically partial view illustrating a first embodiment of the exhaust emission path in the reverse cleaning regeneration type exhaust emission control device according to the invention.

In case of the item (1), as shown in FIG. 8, a megaphone-shaped cylindrical member P1 tapering toward the third path C is attached to an outer peripheral edge of an end face of each of the filters A1 and B1 at their upstream side, whereby a greater part of the reverse cleaning air jetted from the nozzle A3 or B3 can directly be fed to the third path C without flowing backward into the exhaust emission path E.

Figure 9:
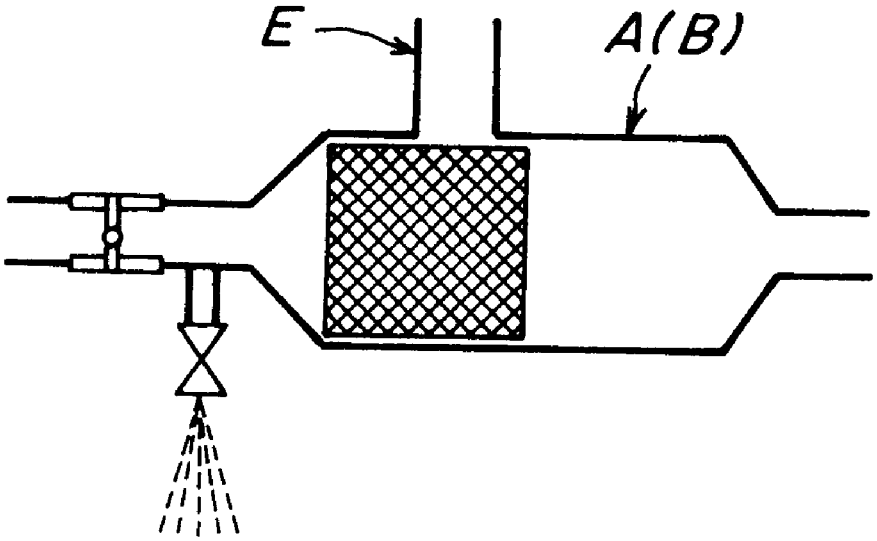
FIG. 9 is a diagrammatically partial view illustrating a second embodiment of the exhaust emission path in the reverse cleaning regeneration type exhaust emission control device according to the invention.

In case of the item (2), the exhaust emission path E is closed to the side face of each of the filters A1 and B1 as shown in FIG. 9, or a greater area of the exhaust emission path E is located so as to overlap with the side face of each of the filters A1 and B1 at the upstream side thereof, whereby a greater part of the reverse cleaning air jetted from the nozzle A3 or B3 can be fed to the third path C without flowing backward to the exhaust emission path E.

In case of the item (3), the size of the exhaust emission path E is made considerably smaller than the size of each of the first and second paths A and B so as to sufficiently ensure the volumes of the first and second paths A and B, whereby a greater part of the reverse cleaning air jetted from the nozzle A3 or B3 can be fed to the third path C without flowing backward to the exhaust emission path E.

Figure 10:
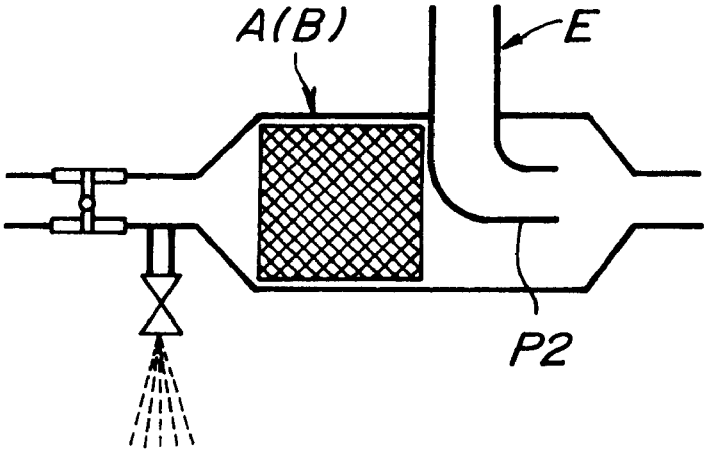
FIG. 10 is a diagrammatically partial view illustrating a third embodiment of the exhaust emission path in the reverse cleaning regeneration type exhaust emission control device according to the invention.

In case of the item (4), as shown in FIG. 10, a top end portion of the exhaust emission path E is inserted into each of the first and second paths A and B and then bent toward a central portion of the third path C, whereby a greater part of the reverse cleaning air jetted from the nozzle A3 or B3 can be fed to the third path C without flowing backward to the exhaust emission path E.

Figure 11:
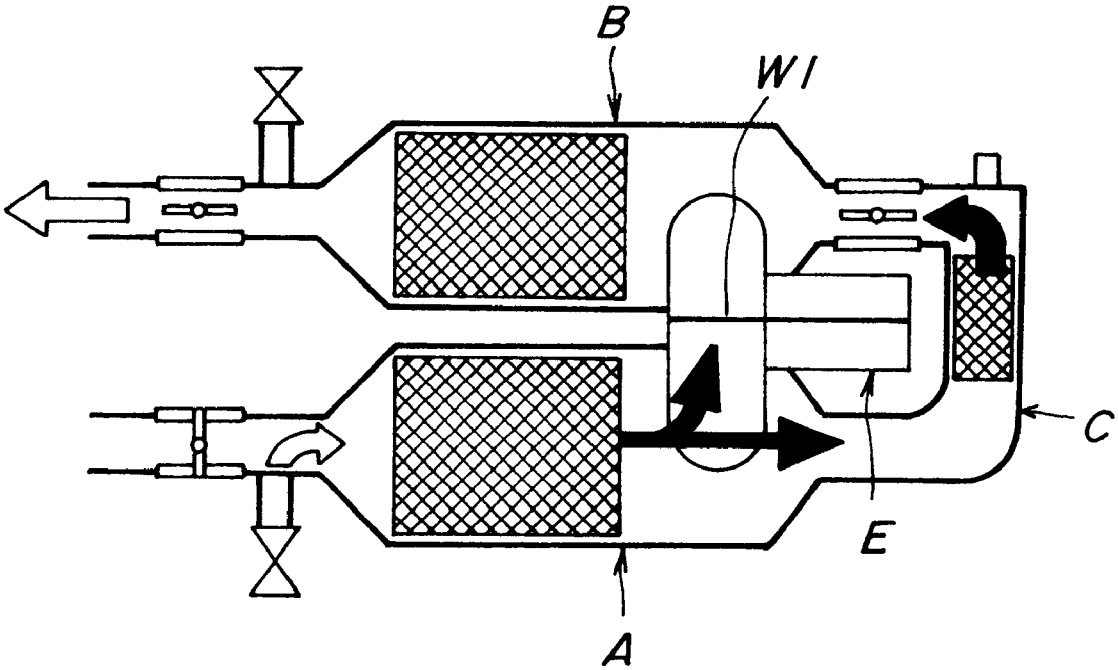
FIG. 11 is a diagrammatic view illustrating a reverse cleaning state of a third embodiment of the reverse cleaning regeneration type exhaust emission control device according to the invention.

In case of the item (5), as shown in FIG. 11, a flat plate W1 as a partition member is disposed in the exhaust emission path E extending from the inlet port of the exhaust emission to divide the exhaust emission path E into two equal parts facing the first and second paths A and B. The material of the partition member is not particularly restricted, but is preferably the same as in the wall member constituting the exhaust emission path E. Further, it is sufficient to extend the partition member from the inlet port to a branched port of the exhaust emission path E. In this case, even if the reverse cleaning air is flown backward to the exhaust emission path E, it is obstructed by the partition member W1 to prevent the flowing of the particulate into the opposed-side path, whereby the lowering of the particulate removing ability can be prevented and also the flowing of the reverse cleaning air into the opposed-side path and the exhaust emission path can surely be prevented.

These means may be used alone or in combination in the same reverse cleaning regeneration type exhaust emission control device in accordance with the use purpose.

In the method according to the invention, either the first or second regeneration treatment is completed after the flowing of the exhaust emission to the first and second paths A and B or the working of the internal combustion engine is stopped. On the other hand, either first or second regeneration treatment is again started after subsequent working of the internal combustion engine is started. In the subsequent working of the engine, the flowing of the exhaust emission can be restarted at a state of removing the particulate from the filter C1, whereby the removal of the particulate and the regeneration treatment can efficiently be carried out. If the first or second regeneration treatment is carried out by restarting the flowing of the exhaust emission at a state of leaving the particulate in the filter C1, the particulate left in the filter C1 is fed to the opposed-side filter by the pressure of the reverse cleaning air jetted, so that the efficiency of removing the particulate is degraded and also the pressure loss may be raised. When the regeneration treatment is carried out after the flowing of the exhaust emission is restarted, it is preferable to start the regeneration from the filter not conducting the regeneration treatment at the time of stopping the working of the device.

In any case, it is favorable to start the regeneration treatment after a given time of the start of flowing the exhaust emission such as 60 seconds or the like because power consumption in the start of the internal combustion engine is temporarily increased by actuation of cell motor or the like.

In order to determine the reverse cleaning of the filter A1 or B1, according to the invention, an amount of the particulate caught is detected by a pressure difference between the upstream side and downstream side of the filter A1 and a pressure difference between the upstream side and the downstream side of the filter B1 and the reverse cleaning is carried out in accordance with the detected value. For this purpose, a pressure sensor is arranged at each of the upstream side and downstream side of the filters A1 and B1, respectively.

Figure 12:
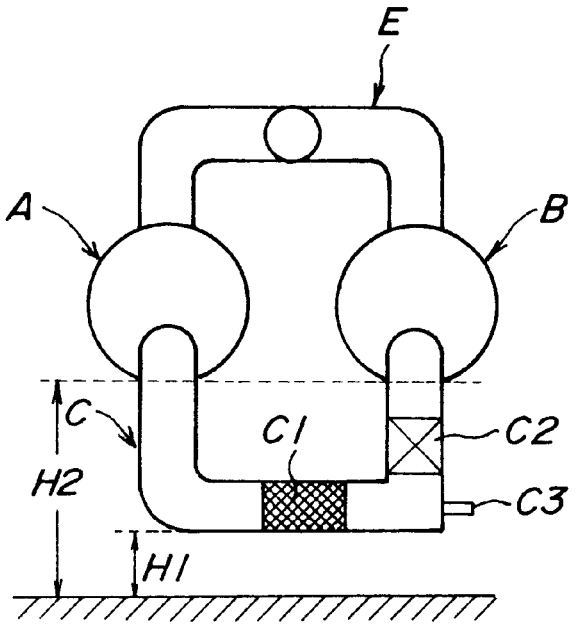
FIGS. 12 and 13 are diagrammatically right side views illustrating an arrangement relation of first, second and third paths A, B, C in the reverse cleaning regeneration type exhaust emission control device according to the invention.
Figure 13:
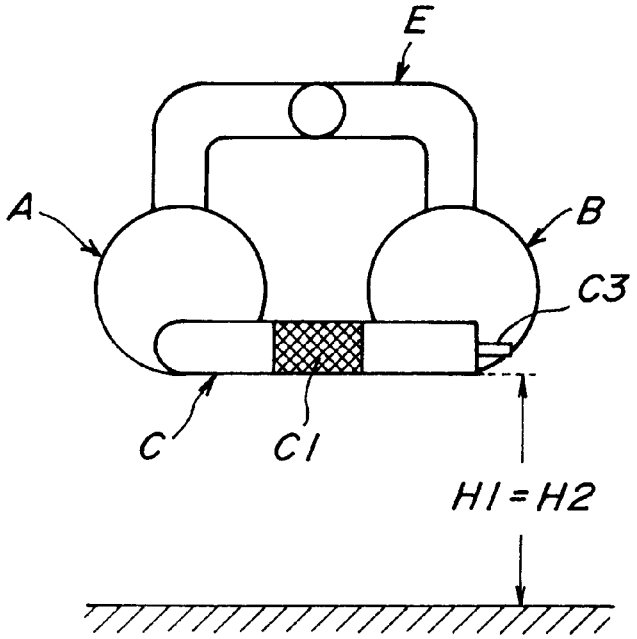

In order to more ensure the removal of the particulate from the filter A1 or B1 by the reverse cleaning of the filter A1 or B1, according to the invention, it is favorable that a lower end position of the filter C1 is arranged so as to be equal to or lower than lower end positions of the filters A1 and B1 when the reverse cleaning air is jetted from the nozzle A3 or B3 to remove the particulate from the filter A1 or B1 and flow into the third path C without depositing in the first or second path A or B as shown in FIGS. 12 and 13. In this case, when the reverse cleaning air is jetted from the nozzle A3 or B3, the particulate removed out from the filter A1 or B1 is surely flowed into the third path C without depositing in the first or second path A or B and caught by the filter C1. Particularly, when the lower end position of the filter C1 is lower than the lower end position of the filter A1 or B1, the particulate falls down into the third path C through gravity, so that the particulate is more efficiently caught by the filter C1.

The following examples are given in illustration of the invention and are not intended as limitations thereof.

EXAMPLE 1

Figure 1:
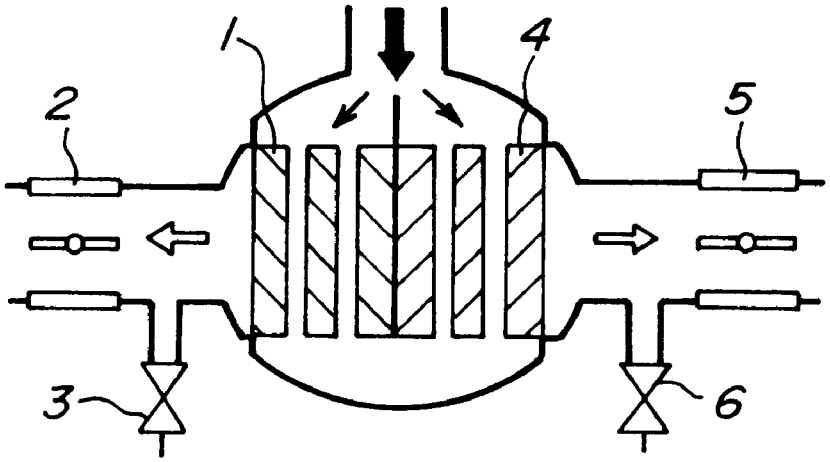
FIG 1 PRIOR ART
FIG. 1 is a diagrammatic view illustrating a steady running state of the conventional reverse cleaning regeneration type exhaust emission control device using two filters.
Figure 2:
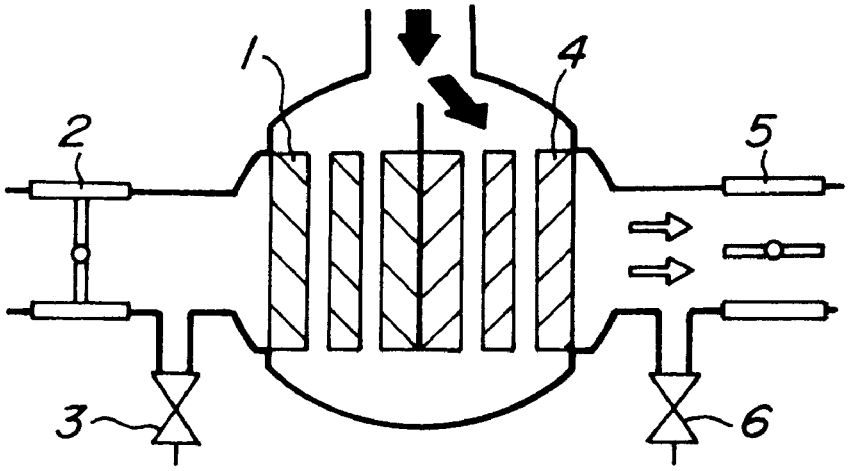
FIG 2 PRIOR ART
FIG. 2 is a diagrammatic view illustrating a state of closing a valve located at a downstream side of one of the two filter in the conventional reverse cleaning regeneration type exhaust emission control device.
Figure 3:
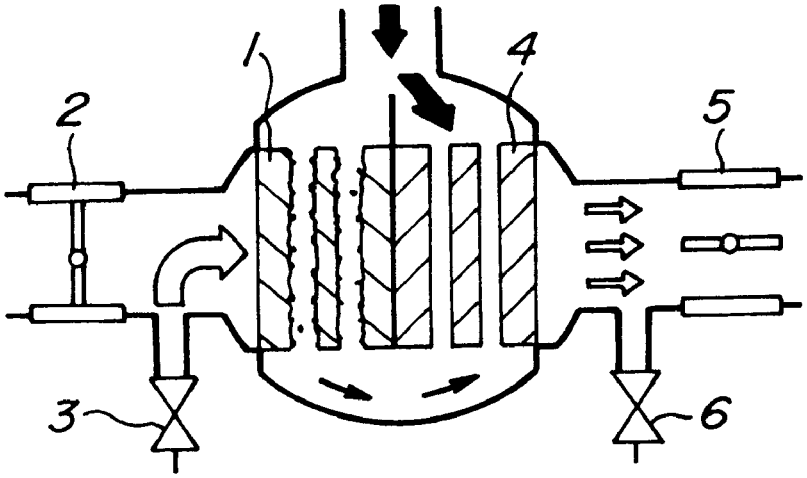
FIG 3 PRIOR ART
FIG. 3 is a diagrammatic view illustrating a reversed cleaning state in the conventional reverse cleaning regeneration type exhaust emission control device.
Figure 4:
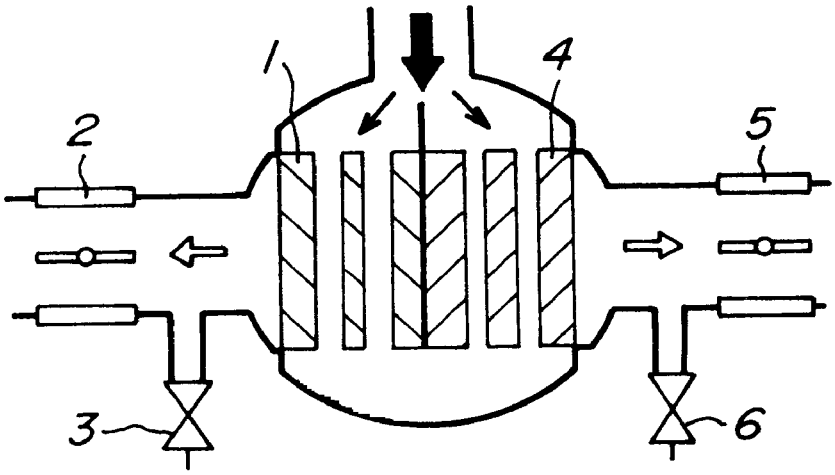
FIG 4 PRIOR ART
FIG. 4 is a diagrammatic view illustrating a state of restarting steady running of the conventional reverse cleaning regeneration type exhaust emission control device.

There is provided a system using a reverse cleaning regeneration type exhaust emission control device as shown in FIGS. 1–3 and the performance of particulate removal thereof is evaluated as follows.

As an internal combustion engine, there is used an engine having a displacement of 7000 cc, in which a driving condition of the engine is 500–1800 rpm.

A reverse cleaning air is jetted from a nozzle A3 or B3 under a pressure of 8 kgf/cm$^2$ for 0.1 second.

Each of filters A1 and B1 is a cylindrical silicon carbide honeycomb body having an interstructure thickness of 0.43 mm, pore number of 30 pores/square inch, a length of 150 mm and a filter capacity of 3.3 liter, and a filter C1 is a cylindrical silicon carbide honeycomb body having an interstructure thickness of 0.43 mm, pore number of 30 pores/square inch, a length of 150 mm and a filter capacity of 0.14 liter.

In order to burn out particulate caught by the filter C1, a heater of 24V–300 W is used, while air for combustion is jetted from a nozzle C3 under a pressure of 6.5 kgf/cm$^2$.

During the running of the engine, the reverse cleanings of the filters A1 and B1 are alternately carried out while continuously removing the particulate by the reverse cleaning regeneration type exhaust emission control device according to the invention.

Figure 14:
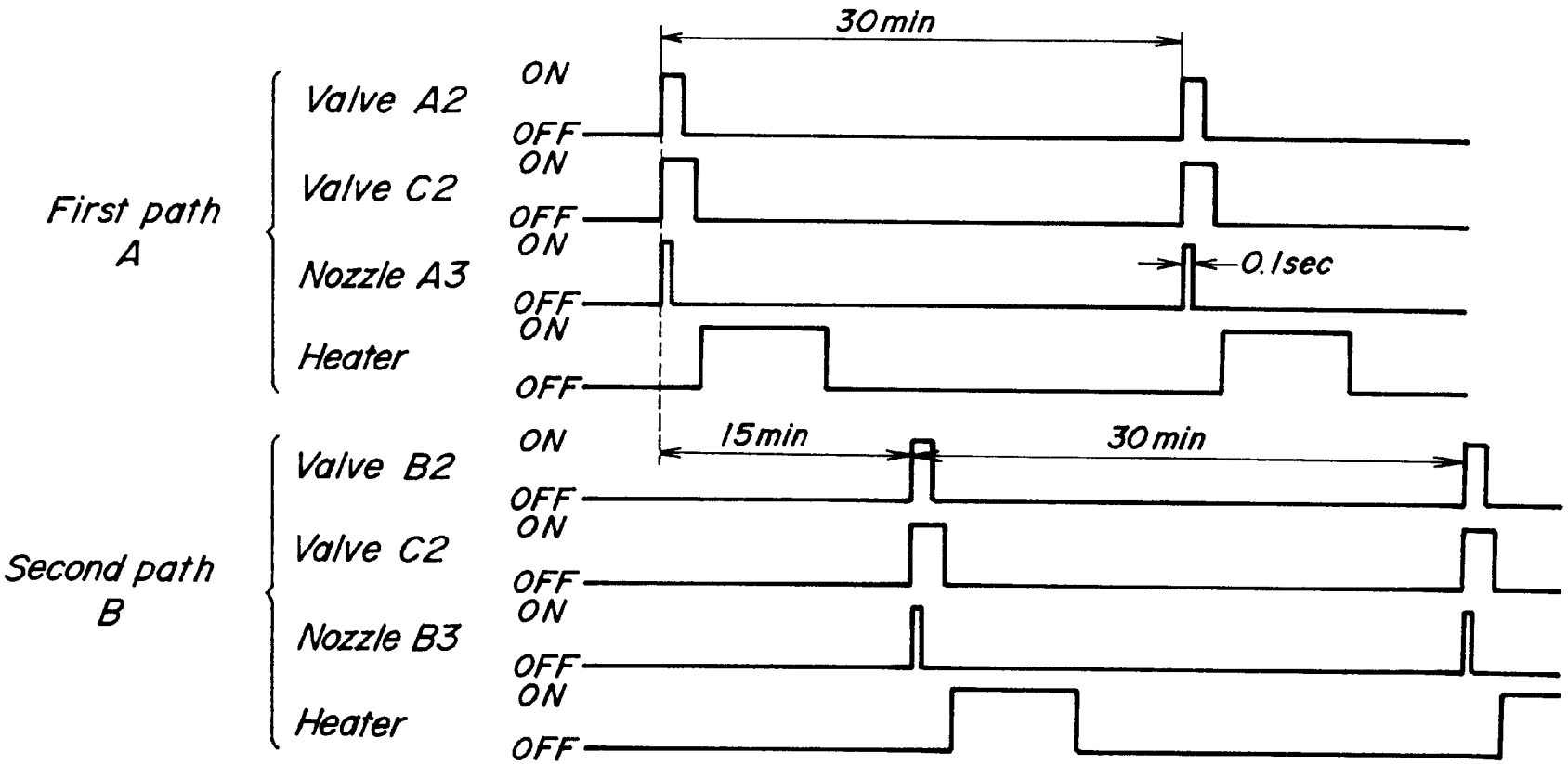
FIG. 14 is a sequence diagram of reverse cleaning in the second embodiment of the device according to the invention.

The above reverse cleaning is carried out according to a sequence diagram shown in FIG. 14. That is, just after the valve A2 is closed and at the same time the valve C2 is opened, the nozzle A3 is opened to jet the reverse cleaning air therefrom and then the filter C1 is heated to 670° C. by means of the heater to burn out the particulate caught by the filter C1. After 15 minutes from the opening of the valve A2, the valve B2 is closed and the valve C2 is opened and then the nozzle B3 is opened immediately to jet the reverse cleaning air therefrom and thereafter the filter C1 is heated to 670° C. by means of the heater to burn out the particulate caught by the filter C1. These procedures are alternately repeated.

After the stop of the engine, the regeneration treatment of the filter A1 or B1 is carried out to burn out the particulate caught by the filter C1 while heating the filter C1 to 670° C. by means of the heater and then the working of the system using the reverse cleaning regeneration type exhaust emission control device is stopped.

During the working of the device, the pressure loss is not more than 2800 mm$H_2O$ and the operation is stable.

After 1600 minutes of the working, the deposition of the particulate in the paths A and B at the upstream side of the filters A1 and B1 is not substantially observed by visually observing the inside of the path.

EXAMPLE 2

The same procedure as in Example 1 is repeated except that a megaphone-shaped cylindrical member P1 tapering toward the third path C is attached to an outer peripheral edge of an end face of each of the filters A1 and B1 at their upstream side as shown in FIG. 8.

When an amount of reverse cleaning air flown into the third path C is Q1 and an amount of reverse cleaning air flown into the exhaust emission path E is Q2, it is confirmed that Q1:Q2 is 10:0.

The pressure loss in the device is not more than 2800 $mmH_2O$, and the deposition of the particulate in the paths A and B is not substantially observed.

EXAMPLE 3

The same procedure as in Example 1 is repeated except that the exhaust emission path E is closed to the side face of each of the filters A1 and B1 as shown in FIG. 9. In this case, it is confirmed that Q1:Q2 is 10:0.

The pressure loss in the device is not more than 4200 $mmH_2O$ and the deposition of the particulate in the paths A and B is not substantially observed.

EXAMPLE 4

The same procedure as in Example 1 is repeated except that a greater area of the exhaust emission path E is located so as to overlap with the side face of each of the filters A1 and B1 at the upstream side thereof. In this case, it is confirmed that Q1:Q2 is 8:2.

The pressure loss in the device is not more than 3360 $mmH_2O$ and the deposition of the particulate in the paths A and B is not substantially observed.

EXAMPLE 5

The same procedure as in Example 1 is repeated except that a pressure sensor is arranged at each of the upstream side and downstream side of the filters A1 and B1, respectively. In this case, when the value of the pressure difference detected by the pressure sensors is 1500 $mmH_2O$, the first or second regeneration treatment of the filter A1 or B1 is started.

During the working of the device, the pressure loss in the device is not more than 2800 $mmH_2O$ and the deposition of the particulate in the paths A and B is not substantially observed.

EXAMPLE 6

The same procedure as in Example 1 is repeated except that the arrangement relation of the lower end portion among the first, second and third paths A, B and C is H1<H2 as shown in FIG. 12 in which H1 is a height from ground surface to the lower end position of the filer C1 and H2 is a height from ground surface to the lower end position of each of the filters A1 and B1.

During the working of the device, the engine torque does not decrease and the lowering of fuel consumption can be prevented. Further, the pressure loss in the device is not more than 2800 $mmH_2O$ and the deposition of the particulate in the paths A and B is not substantially observed.

EXAMPLE 7

The same procedure as in Example 1 is repeated except that the arrangement relation of the lower end portion among the first, second and third paths A, B and C is H1=H2 as shown in FIG. 13.

During the working of the device, the engine torque does not decrease and the lowering of fuel consumption can be prevented. Further, the pressure loss in the device is not more than 2800 $mmH_2O$ and the deposition of the particulate in the paths A and B is not substantially observed.

As mentioned above, according to the invention, the reverse cleaning can continuously and efficiently be carried out by using the reverse cleaning regeneration type exhaust emission control device.

What is claimed is:

1. A reverse cleaning regeneration type exhaust emission control device comprising two exhaust emission routes communicated with an inlet port of an exhaust emission and comprised of a first path comprising a first filter, a first valve arranged at a downstream side of the first filter for shutting off exhaust emission and a first nozzle disposed between the first filter and the first valve for jetting reverse cleaning air to the first filter and a second path comprising a second filter, a second valve arranged at a downstream side of the second filter for shutting off exhaust emission and a second nozzle disposed between the second filter and the second valve for jetting reverse cleaning air to the second filter, and a third path arranged at an upstream side of the first and second filters separately from the exhaust emission path extending from the inlet port of the exhaust emission and communicating with the two exhaust emission routes and comprising a third filter, a third valve arranged at any side of the third filter for intercepting the path and a third nozzle disposed between the third filter and the third valve for feeding air for combustion to the third filter.

2. A reverse cleaning regeneration type exhaust emission control device according to claim 1, wherein a guide member for introducing the reverse cleaning air into the third path is arranged on an end face of each of the first and second filters at its upstream side.

3. A reverse cleaning regeneration type exhaust emission control device according to claim 1, wherein the exhaust emission path from the inlet port of the exhaust emission to the first and second paths is arranged close to the first and second filters.

4. A reverse cleaning regeneration type exhaust emission control device according to claim 1, wherein a size of each of the first path, second path and the exhaust emission path is defined so as to suck the exhaust emission into a main stream of the reverse cleaning air.

5. A reverse cleaning regeneration type exhaust emission control device according to claim 1, wherein guide members for introducing the exhaust emission into the first and second paths and are arranged on the exhaust emission path.

6. A reverse cleaning regeneration type exhaust emission control device according to claim 1, wherein a partition member is disposed in the exhaust emission path extending from the inlet port of the exhaust emission.

7. A method of regenerating a reverse cleaning regeneration type exhaust emission control device comprising two exhaust emission routes communicated with an inlet port of an exhaust emission and comprised of a first path comprising a first filter, a first valve arranged at a downstream side of the first filter for shutting off exhaust emission and a first nozzle disposed between the first filter and the first valve for jetting reverse cleaning air to the first filter and a second path comprising a second filter, a second valve arranged at a downstream side of the second filter for shutting off exhaust emission and a second nozzle disposed between the second filter and the second valve for jetting reverse cleaning air to the second filter, and a third path arranged at an upstream side of the first and second filters separately from the inlet port of the exhaust emission and communicating with the two exhaust emission routes and comprising a third filter, a third valve arranged at any side of the third filter for intercepting the path and a third nozzle disposed between the third filter and the third valve for feeding air for combustion to the third filter, the method comprising:

alternately repeating a first regeneration treatment and a second regeneration treatment after the exhaust emission is passed through the first and second filters at opened state of the first and second valves to catch particulate from the exhaust emission by the first and second filters, wherein:

the first regeneration treatment comprises jetting the reverse cleaning air from the first nozzle at a state of closing the first valve and opening the third valve to remove the particulate from the first filter, catching the removed particulate with the third filter and then feeding air for combustion from the third nozzle at a state of opening the first valve and closing the third valve to burn out the particulate in the third filter, and the second regeneration treatment comprises jetting the reverse cleaning air from the second nozzle at a state of closing the second valve and opening the third valve to remove the particulate from the second filter, catching the removed particulate with the third filter and then feeding air for combustion from the third nozzle at a state of opening the second valve and closing the third valve to burn out the particulate in the third filter.

8. The method according to claim 7, wherein after the flowing of the exhaust emission is stopped to the first and second paths, either the first or second regeneration treatment is completed, or after the flowing of the exhaust emission is started to the first and second paths, either the first or second regeneration treatment is started.

9. The method according to claim 7, wherein an amount of the particulate caught is detected by a pressure difference between the upstream side and downstream side of the first filter and a pressure difference between the upstream side and the downstream side of the second filter and the reverse cleaning is carried out in accordance with the detected value.

10. The method according to claim 7, wherein a lower end position of the third filter is arranged so as to be equal to or lower than lower end positions of the first and second filters when the reverse cleaning air is jetted from the first or second nozzle to remove the particulate from the first or second filter and flow into the third path without depositing in the first or second path.

* * * * *